United States Patent [19]

Smith

[11] 4,086,831

[45] May 2, 1978

[54] RATCHET DRIVER

[75] Inventor: Lloyd T. Smith, Newton, Kans.

[73] Assignee: S/V Tool Company, Inc., Newton, Kans.

[21] Appl. No.: 763,529

[22] Filed: Jan. 28, 1977

[51] Int. Cl.[2] ..... B25B 13/46

[52] U.S. Cl. ..... 81/62; 145/63; 145/75

[58] Field of Search ..... 81/62, 60, 58, 63.1; 145/62, 63, 75, 76

[56] References Cited

U.S. PATENT DOCUMENTS

| | | | |
|---|---|---|---|
| 1,436,640 | 11/1922 | Blevney | 145/75 |
| 1,493,353 | 5/1924 | Leopold | 145/75 |
| 2,337,514 | 12/1943 | Wilcox | 145/62 |
| 3,007,504 | 11/1961 | Clark | 81/125 |

*Primary Examiner*—James L. Jones, Jr.

*Attorney, Agent, or Firm*—Schmidt, Johnson, Hovey & Williams

[57] ABSTRACT

A screwdriver including a relatively large teardrop-shaped, hollow handle, comfortable to the hand for delivering increased turning power, is provided with a self-contained ratchet mechanism which, in turn, has a three-position ratchet control (forward, reverse and lock). The shank of the screwdriver houses a magnet for releasably holding any one of a number of bits in place during use. The handle has a series of finger-engageable projections on its stem to assist the operator in applying torque and for storage of bits therein. A retainer ring on the stem holds the bits in the chambers until indexed to a bit-releasing position.

7 Claims, 6 Drawing Figures

RATCHET DRIVER

It is an important object of the present invention to provide a screwdriver having a handle shaped and sized to eliminate the problems incident to the requirement of simultaneously applying torque thereto while at the same time applying end pressure to maintain the bit within the kerf of the screw and forcing the latter endwise into the workpiece.

Another important object of the instant invention is to provide a screwdriver in which the aforementioned handle is advantageously utilized for housing a three-position ratchet control to permit both application and removal of screws as well as a lock position when the handle and shank of the screwdriver are locked against relative rotation.

Still another important object of my present invention is to provide for interchangeable bits including a magnetic bit holder and storage chambers therefor with the chambers being formed in the handle itself in such a manner as to additionally facilitate the application of torque, together with a special bit retainer made to render the entire assembly compact and self-contained.

Figure 1:
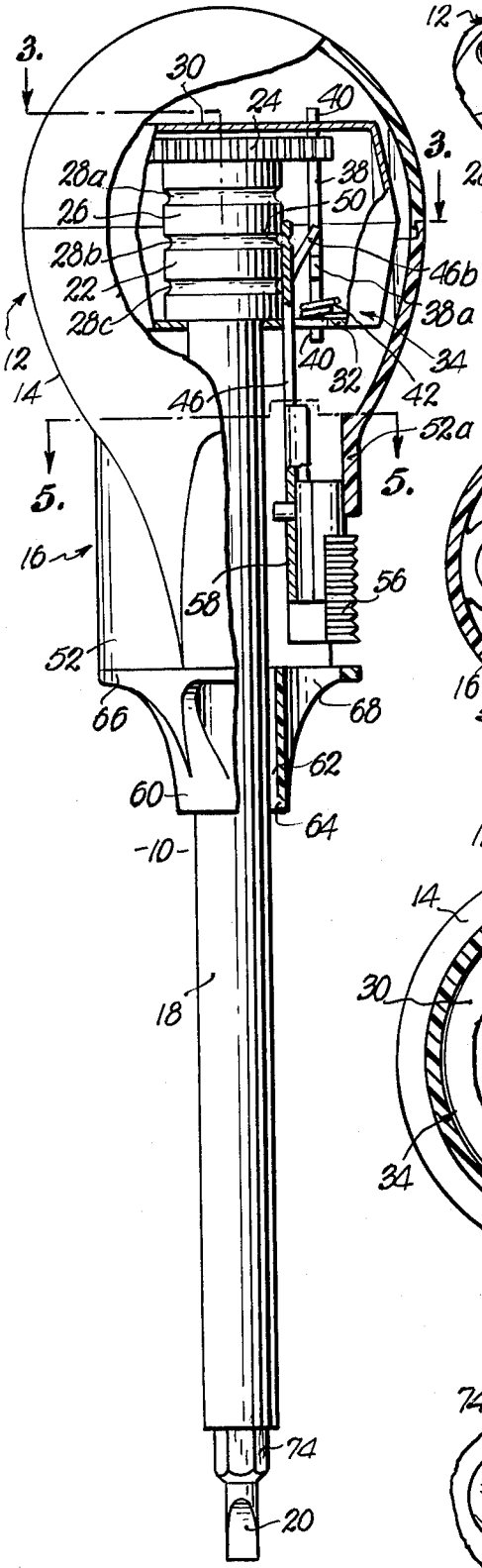
FIG. 1 is a side-elevational view of a ratchet driver made pursuant to my present invention, parts being broken away and in section for clearness.

Screwdriver 10 includes a hollow handle 12 that is tear-drop shaped, presenting a bulb 14 and a stem 16. An elongated, tubular shank 18 rotatably carried by the handle 12 is adapted to mount any one of a number of short bits 20 at that end of the shank 18 remote from the handle 12.

The handle 12 houses a ratchet mechanism 22 which includes a toothed ratchet wheel 24 rigidly secured to the shank 18 for rotation therewith and a sleeve 26 provided with a number of circumferential grooves **28*a*, 28*b* and 28*c*, the wheel 24 and the sleeve 26 being disposed between a pair of spaced walls 30 and 32 of a cage 34 for holding the shank 18** against movement along its longitudinal axis.

The walls 30 and 32 similarly support a pair of pawl plates 36 and 38 therebetween by virtue of opposed pintles 40 on each plate 36 and 38 rotatably extending through the walls 30 and 32. A spring 42 coiled about one of the pintles 40 of each of the plates 36 and 38 has its end bearing against tabs 44 on the plates 36 and 38 to yieldably bias the plates 36 and 38 into engagement with the teeth of the wheel 24.

Plates 36 and 38 are provided with ears **36*a* and 38*a* disposed for actuation by an elongated, leaf-spring type of control bar 46 reciprocably carried by the handle 12. The bar 46 has a pair of prongs 46*a* and 46*b* alternatively engageable with corresponding ears 36*a* and 38*a*** respectively.

The bar 46 is carried by a pair of oposed slots 48 in the stem 16 and extends therebeyond through the wall 32, terminating within the cage 34. A detent 50 on the bar 46 is adapted to be received by any selected one of the grooves **28*a*, 28*b* and 28*c***.

The stem 16 has a series of tubular projections 52, there of which present storage chambers 54 for the bits 20. One of the projections **52*a* receives a manually manipulable, ribbed slide button 56 secured to the bar 46 and reciprocable within a raceway 58 formed in the projection 52*a* and in the button 56**.

One end of each of the chambers 54 is closed to prevent passage of the bits 20 into the bulb 14 whereas the opposite ends of the chambers 54 adjacent a retainer 60 are open.

The retainer 60 is rotatable on and surrounds a plurality of legs 62 which in turn surround the shank 18 and form a part of the stem 16. A groove-rib arrangement 64 between the retainer 60 and the legs 62 holds the retainer 60 in place, and the retainer 60 is provided with four essentially circular, radially extended spokes 66, one of which has an opening 68 therein. At least one of the spokes 66 is provided with a circular boss 70 which snaps into the open ends of the chambers 54, rendering the retainer 60 indexable.

A magnet 72 is mounted in the shank 18 adjacent that end of the shank 18 remote from the retainer 60, and each of the bits 20 is made, at least in part, from ferrous material so that the magnet 72 attracts the bits 20, thereby presenting a mount for the latter. The bits 20 are provided with flats 74 which mate with the corresponding, non-circular female configuration of the shank 18 at the magnet 72 to hold the bits 20 against rotation relative to shank 18.

Figure 2:
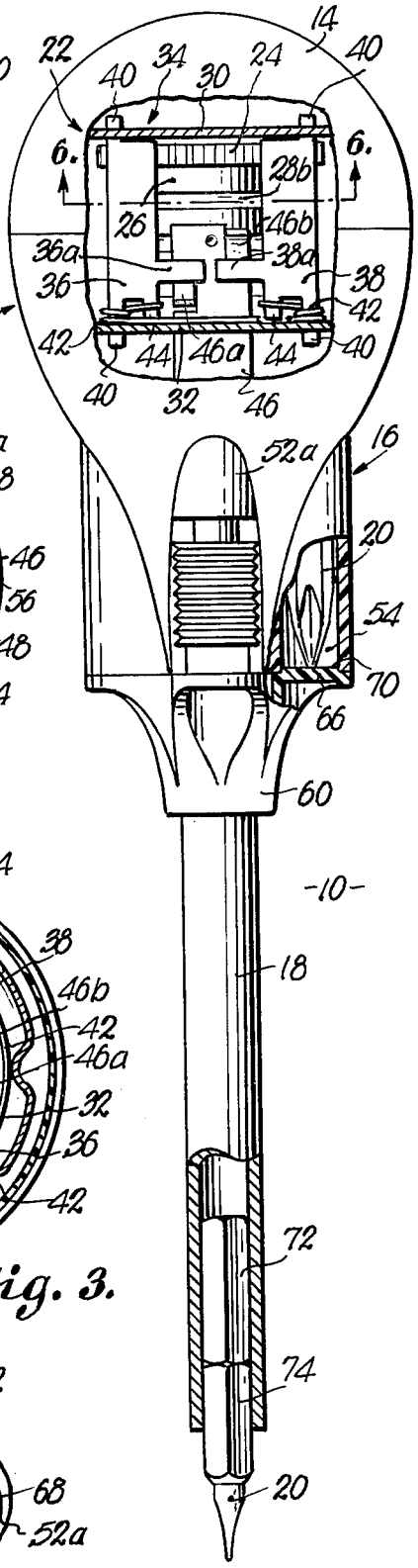
FIG. 2 is a side-elevational view taken essentially at right angles to FIG. 1 with parts broken away and in section to reveal details of construction.

As noted in FIG. 1, the retainer 60 is normally in a position where the opening 68 is aligned with the projection **52*a* whereby the three remaining spokes 66 maintain a corresponding number of the bits 20 within the chambers 54. In order to retrieve one of the bits 20 it is but necessary to rotate the retainer 60 on the legs 62 to align the opening 68 with chamber 54 having the desired bit 20 stored therein. Such selected bit 20 is then simply inserted into the shank 18 as illustrated FIG. 2, where it is held in place by the action of magnet 72**.

In the event a screw is to be inserted into a workpiece, the button 56 is shifted toward the bulb 14 and, by virtue of the yieldable nature of the bar 46, the detent 50 will seat within the groove **28*a***.

This action shifts the prong **46*a* into engagement with the ear 36*a*, thereby swinging the plate 36 against the action of the spring 42 out of engagement with the teeth of the wheel 24. Accordingly, as the handle 12 is grasped and rotated in one direction, the screw will be rotated in the workpiece and as the handle 12 is rotated in the opposite direction, the spring-loaded plate 38 will clear the teeth of the wheel 24** in ratchet fashion.

Figure 6:
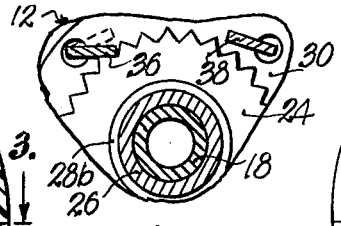
FIG. 6 is a fragmentary cross-sectional view taken on line 6—6 of FIG. 2.
Figure 5:
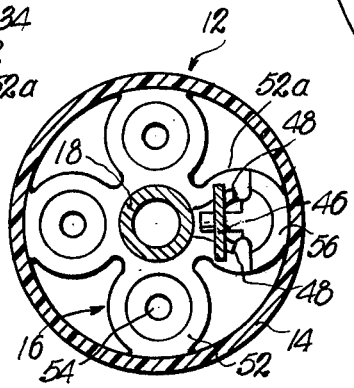
FIG. 5 is a cross-sectional view taken on line 5—5 of FIG. 1.
Figure 3:
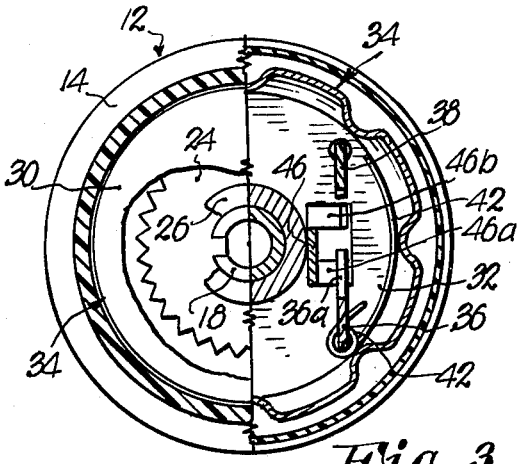
FIG. 3 is a cross-sectional view taken on irregular line 3—3 of FIG. 1.
Figure 4:
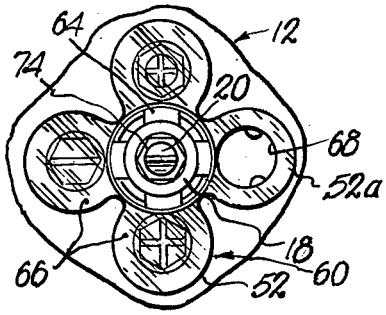
FIG. 4 is a fragmentary end view.

Conversely, in the event it is desired to remove a screw through use of the screwdriver 10, the button 56 is shifted to a position placing the detent 50 into the groove **28*c*, thereby causing the prong 46*b* to engage the ear 38*a* so that the plate 38 is released from the wheel 24 and the plate 36 is in ratchet engagement with the teeth of wheel 24 as shown in FIG. 6**.

Still further, if it is desired to lock the mechanism 22, preventing rotation of the shank 18 in both directions, it is but necessary to place the detent 50 within the groove **28*b*. When the buttom 56 is thus intermediate the ends of its path of travel, the ears 36*a* and 38*a* are between the prongs 46*a* and 46*b* such that both of the plates 36 and 38 are yieldably held in engagement with the teeth of the wheel 24**.

Not to be overlooked is the fact that when the bit 20 is within the kerf of the screw being applied or removed, the screw itself is being attracted and held in place on the bit 20 by the attraction of the magnet 72.

Still further, it is to be noted that the bulbar shape of the handle 12 facilitates the application of torque as well as pressure against the screw longitudinally of the shank 18 because of the comfortable fit of the bulb 14 within the hand of the operator. That manual action is augmented additionally by virtue of the fact that the projections 52 solve the additional function of permitting the operator to finger engage the projections 52 and prevent his hand from sliding rotationally on the handle 12.

Having thus described the invention, what is claimed as new and desired to be secured by Letters Patent is:

1. A screwdriver including:

a handle having a teardrop configuration presenting a bulb and a stem;

an elongate shank secured at one end thereof to said handle;

a plurality of bits adapted for releasable mounting on the other end of said shank; and a series of projections on said stem for facilitating the application of torque to handle during use, said projections being hollow, presenting individual storage chambers for said bits, said chambers each having an open and a closed end, said open ends facing toward said other end of the shank, there being an indexable retainer rotatably mounted on said handle remote from said bulb and in normally closed relationship to said open ends, said retainer having an opening formed therein for providing access into any selected one of said chambers when the retainer is rotated to a position wherein said opening is aligned with the open end of the selected chamber.

2. The invention of claim 1; and a ratchet mechanism, said mechanism including:

a toothed ratchet wheel rigidly secured to said shank for rotation with the latter;

a pair of pawl plates shiftably mounted on said handle for movement indpendently to and from engagement with the teeth of said wheel;

one of said plates being disposed to preclude relative clockwise rotation between said handle and shank when the one plate engages said teeth;

means yieldably biasing said plates toward said teeth; and a control bar mounted on said handle adjacent said plates for reciprocal movement along a predetermined path of travel;

said plates each having an ear, said bar having a pair of prongs disposed for engagement with respective ears to disengage a corresponding plate from said teeth, one of said prongs being disposed to disengage said one plate from the teeth when the bar is in a first position, the other of said prongs being disposed to disengage said other plate from the teeth when the bar is in a second position, said prongs being disposed out of engagement with the ears when the bar is in a third position.

3. The invention of claim 2; and cooperative parts on the bar and on the shank for releasably holding the bar in any selected one of said positions of the bar.

4. The invention of claim 3, said parts comprising a detent on the bar and structure on the shank having a series of detent receiving grooves within the path of travel of the detent.

5. The invention of claim 2, the handle being hollow and containing said mechanism; and a manually manipulable slide button exteriorly of the handle and secured to the bar for actuating the latter.

6. The invention of claim 5, one of said projections providing a raceway for said button.

7. The invention of claim 1; and a mount for releasably mounting a selected bit on one end of said shank, said mount including:

a female portion in one end of said shank extending longitudinally of the latter, said portion presenting a bit-receiving cavity of non-circular cross-section;

a male portion on said bit, said male portion being configured to mate with said female portion when the bit is inserted into the cavity for preventing rotation of the bit relative to the shank; and a magnet secured to said shank adjacent said female portion, said bit being provided with ferrous material such that said magnet effects a holding force on said bit when the latter is mated with said female portion.

* * * * *